United States Patent [19]

Verma

[11] 4,154,977

[45] May 15, 1979

[54] MULTICONDUCTOR CABLE ADAPTED FOR MASS TERMINATION AND FOR USE IN LIMITED SPACE

[75] Inventor: Surendra Verma, Vernon, Conn.

[73] Assignee: Akzona Incorporated, Asheville, N.C.

[21] Appl. No.: 791,829

[22] Filed: Apr. 28, 1977

[51] Int. Cl.[2] ..... H01B 7/08

[52] U.S. Cl. ..... 174/117 F; 29/423; 174/72 A; 174/117 A; 339/29 R; 428/352

[58] Field of Search ..... 174/117 R, 117 F, 117 FF, 174/117 A, 72 A; 339/28, 29 R, 148; 156/289, 47; 428/352; 29/423

[56] References Cited

U.S. PATENT DOCUMENTS

| | | | |
|---|---|---|---|
| 2,526,483 | 10/1950 | Ingmanson | 174/117 R |
| 3,736,366 | 5/1973 | Wittenberg | 174/117 F |
| 4,113,335 | 9/1978 | Lang et al. | 174/72 A X |

FOREIGN PATENT DOCUMENTS

| | | | |
|---|---|---|---|
| 1515828 | 4/1965 | Fed. Rep. of Germany | 175/117 F |
| 850915 | 12/1939 | France | 174/117 FF |
| 41-12333 | 7/1966 | Japan | 174/117 A |

OTHER PUBLICATIONS

Hackh's Chemical Dictionary, p. 659.

*Primary Examiner*—Laramie E. Askin
*Assistant Examiner*—E. F. Borchelt
*Attorney, Agent, or Firm*—Francis W. Young; David M. Carter

[57] ABSTRACT

An improved cable is provided having both the advantages of mass termination of flat cable and the flexibility of a cable with independent conductors for use in limited space situations. A plurality of substantially parallel and aligned insulated conductors is provided having a layer of flat backing material substantially covering the conductors. There is a layer of adhesive between the conductors and the backing. A further layer of a nonadhesive material is utilized over the adhesive so that the adhesive will not stick to itself in the event that the cable is bent. The adhesive bond between the conductors and the backing material is such that the backing is easily hand peeled from the conductors.

4 Claims, 4 Drawing Figures

MULTICONDUCTOR CABLE ADAPTED FOR MASS TERMINATION AND FOR USE IN LIMITED SPACE

BACKGROUND OF THE INVENTION

This invention relates to an improved flat cable. More particularly, it relates to a cable having the versatility of mass termination of the individual conductors as well as for use in limited space applications by the easy removal of a tape backing so that the wires may move independent of one another.

In many wiring applications, there is a limitation of available space and the wires have to be folded, twisted, or bunched together to fit into the room available. One such application quite often occurs in computer jumper applications. In these applications, it is a common practice to use single insulated wires cut to size, stripped, if necessary, and connected by soldering or crimping one wire at a time. This type of termination process is time consuming and expensive.

In recent times, flat cable having a plurality of conductors laminated together have come into common practice. The main advantage to a flat cable is the fact that individual wires can be mass terminated or gang terminated to a connector. That is, the conductors are terminated all at the same time, thus, eliminating the expensive and time consuming process of stripping and connecting one wire at a time. However, uses of flat cable in applications where space is limited has created a problem because the laminated cable cannot easily have its shape changed in order to conform to the available space. It is, therefore, desirable to provide a cable which has the termination advantages of a flat cable and the flexibility of an individually wired cable.

OBJECTS OF THE INVENTION

It is one object of this invention to provide an improved flat cable.

It is another object to provide a cable which is versatile enough to have the flexibility of being mass terminated in its flat cable form but its individual conductors may be moved independent of one another in its other form.

It is another object to provide an improved flat cable adapted to be mass terminated as well as used in places where there is limited space.

SUMMARY OF THE INVENTION

In accordance with one form of this invention, there is provided a cable having a plurality of substantially parallel and aligned conductors. A layer of flat backing material substantially covers the conductors. A layer of adhesive is between the conductors and the backing. The adhesive bond between the backing and the insulated conductors is such that the backing is readily peeled from the conductors by hand. The conductors are thus adapted to be gang terminated to a connector while the backing is attached to the conductors and the conductors may be moved about after the removal of the backing.

BRIEF DESCRIPTION OF THE DRAWINGS

The subject matter which is regarded as the invention is set forth in the appended claims. The invention itself, however, together with further objects and advantages thereof may be better understood by reference to the following description taken in conjunction with the accompanying drawings in which:

DESCRIPTION OF THE PREFERRED EMBODIMENTS

Figure 1:
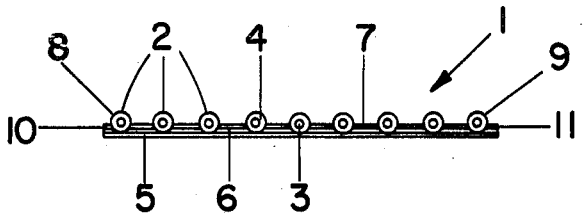
FIG. 1 is a cross-sectional end view of the cable showing some of the aspects of this invention.

Referring now more particularly to FIG. 1, there is provided flat cable 1 having a plurality of substantially parallel and aligned insulated conductors 2. The insulated conductors include conductor 3 and insulation 4, which may be made of various materials such as copper and PVC, respectively. Cable 1 includes backing material 5. Backing 5 may be a paper product or a plastic-type backing. Adhesive material 6 is between backing 5 and insulated conductors 2. Adhesive 6 may be well-known commercially available adhesive such as a rubber based adhesive. The combination of the adhesive 6 and backing 5 may be in the form of a tape. One such commercially available tape is a rubber based adhesive pressure sensitive masking tape available from Armak Company.

Cable 1 may also include a layer 7 which is non-adhesive material such as Talcom powder which will adhere to the adhesive, thus, if cable 1 is folded, the adhesive 6 will not stick to itself. As can be seen, the Talcom powder layer 7 only exists between the insulated conductors 2 and between each outer insulated conductor 8 and 9 and the respective extreme edges of the cable 10 and 11.

Figure 2:
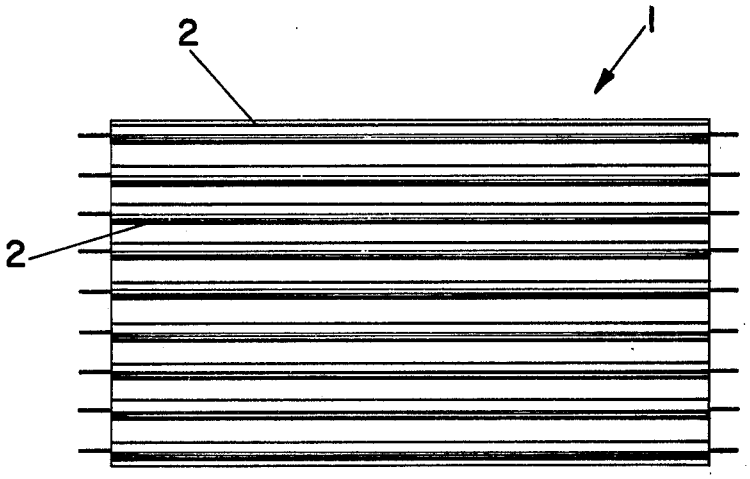
FIG. 2 is a top view of the cable of the present invention.

Referring now more particularly to FIG. 2, there is shown a top view of cable 1 with the insulated conductors 2 on the top side. As can be seen, the insulated conductors are held in alignment and are substantially parallel so that they may be readily gang terminated with a connector, thus alleviating the costly problem of individually terminating the conductors 2. In many applications, it is desirable to remove the backing from the insulated conductors so that the conductors may be made to conform to the space available. This may be better understood in reference to FIG. 3.

Figure 3:
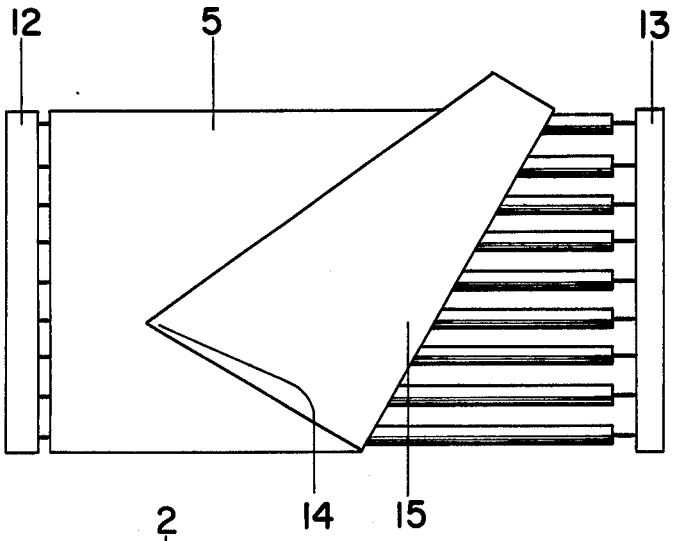
FIG. 3 is a bottom view of the cable of the present invention.

FIG. 3 shows a bottom view of the cable incorporating features of the present invention. The cable shown in FIG. 2 is first gang terminated at both ends by connectors 12 and 13, respectively. These connectors may be a standard commercially available item such as the AMP CHAMP connector. The cable may or may not have the insulation on conductor stripped prior to termination, depending on the type of connector. Some connectors may be gang terminated directly to an insulated wire by using an insulation pierce-type mechanism.

After the wires have been terminated, the backing 5 is removed from the individual conductors by hand peeling the backing from the conductors as indicated by a portion 14 of backing 5 in FIG. 3. Of course, most of the adhesive 6 and Talcom 7 will also be peeled away from the cable. That is, most of the adhesive 6 and the Talcom 7 will remain on the front side 15 of backing 5. This leaves the conductors free to be moved individually. This feature is seen better with reference to FIG. 4.

Figure 4:
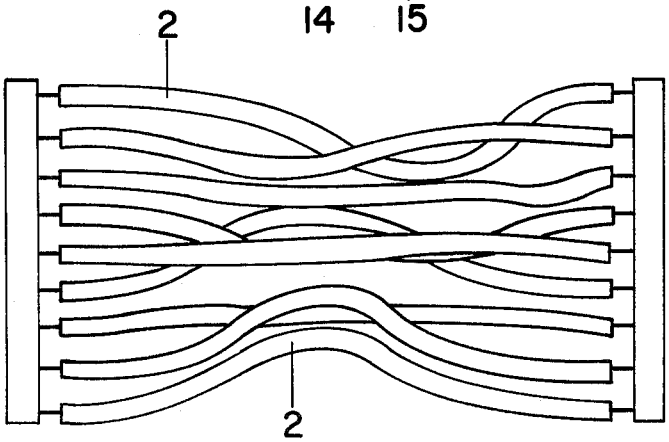
FIG. 4 is a top view of the cable of FIG. 3, wherein all the backing has been removed and the individual conductors have been shaped to conform to a particular application.

FIG. 4 shows the cable with the backing 5 completely removed. The individual conductors 2 are oriented for use in a particular application where there is limited space available.

The cable set forth herein may be manufactured by first laminating masking tape having backing 5 and adhesive 6 to a plurality of parallel conductors 2 in a manner well known in the art. The temperature of the roller at the place of lamination may be kept above room temperature, about 100° F., in order to increase the tackiness of the adhesive. Talcom 7 is then applied by hand onto the top of the cable. The ends of the cable may be gang terminated by an appropriate connector. The tape is then removed from the conductor so that the cable may be used in limited space applications.

From the foregoing description of the embodiment of the invention, it will be apparent that many modifications may be made therein. It will be understood, however, that this embodiment of the invention is intended as an exemplification of the invention only and the invention is not limited thereto. It will be understood, therefore, that it is intended in the appended claims to cover all such modifications as fall in the true spirit and scope of the invention.

What is claimed is:

1. A cable comprising: a plurality of substantially parallel and aligned individually insulated conductors; a layer of backing material substantially covering one side of said conductors; a layer of adhesive substantially covering one side of said backing material and being between said conductors and said backing; the adhesive bond between said backing and said conductors being of such strength that the backing is readily peeled from said conductors by hand without the need for ancillary equipment; said cable being adapted to be gang terminated to a connector while said backing is on said conductors and said conductors being adapted to be separately moved about after the removal of said backing; a layer of non-adhesive material over said adhesive layer on at least a portion of said adhesive not in contact with said conductors.

2. A cable as set forth in claim 1 wherein masking tape forms said backing and said adhesive.

3. A cable as set forth in claim 1 wherein said non-adhesive material is talc.

4. A cable as set forth in claim 1 wherein said portion of said adhesive covered with a non-adhesive is between the outer longitudinal edges of said backing and the insulated conductor nearest said edges.

* * * * *